United States Patent [19]

Mumby et al.

[11] 4,386,422

[45] May 31, 1983

[54] SERVO VALVE FOR WELL-LOGGING TELEMETRY

[75] Inventors: Edward S. Mumby, Sacramento, Calif.; John D. Jeter, Iowa Park, Tex.

[73] Assignee: Exploration Logging, Inc., Sacramento, Calif.

[21] Appl. No.: 190,626

[22] Filed: Sep. 25, 1980

[51] Int. Cl.[3] ..... G01V 1/40

[52] U.S. Cl. ..... 367/85; 175/40; 175/50; 367/83

[58] Field of Search ..... 367/83–85; 175/40, 48, 50, 45; 73/152

[56] References Cited

U.S. PATENT DOCUMENTS

| | | | |
|---|---|---|---|
| 2,759,143 | 8/1956 | Arps | 367/83 |
| 3,737,843 | 6/1973 | Le Peuvedic et al. | 367/85 |
| 3,958,217 | 5/1976 | Spinnler | 367/83 |
| 4,078,620 | 3/1978 | Westlake et al. | 367/83 |
| 4,266,606 | 5/1981 | Stone | 367/85 |

FOREIGN PATENT DOCUMENTS

| | | | |
|---|---|---|---|
| 2852575 | 7/1979 | Fed. Rep. of Germany | 367/85 |

*Primary Examiner*—Howard A. Birmiel

*Attorney, Agent, or Firm*—Christie, Parker & Hale

[57] ABSTRACT

A monostable valve for insertion in a drill string used in forming a borehole such as an oil well. In an open position, the valve vents drilling fluid flowing in the drill string to an annulus in the borehole for return flow to the surface, thus generating a surface-detectable negative fluid-pressure pulse. A valve closure member is supported for horizontal movement to provide significant isolation from vertical accelerations occurring during drilling, and the closure member and associated valve seat are field replaceable. Primary power for valve actuation is drawn from the drilling-fluid hydraulic energy as controlled by a low-power solenoid-actuated pilot valve.

20 Claims, 4 Drawing Figures

SERVO VALVE FOR WELL-LOGGING TELEMETRY

BACKGROUND OF THE INVENTION

In the drilling of deep boreholes such as oil wells, it is desirable to monitor certain downhole conditions, and to transmit information on these conditions to the surface for the guidance of the driller. Typical parameters of interest include temperature, pressure, borehole orientation or deviation from vertical, and a variety of other geophysical data relating to the formation being penetrated. The variables of interest are typically monitored by various forms of transducers which convert the parameter (e.g. pressure) into an electrical signal for transmission directly to the surface in a wired system, or which is used to command some form of wireless telemetry system for transmitting a surface-detactable signal.

Direct or "hard-wired" transmission systems present significant difficulty in that the cable or similar conductors are susceptible to damage and are awkward to manipulate during drilling. A more satisfactory approach which has found considerable acceptance in the drilling industry involves generation of drilling-fluid pressure pulses which are propagated to the surface through the flowing column of drilling fluid or "mud." These systems are wireless transmitters, and the pressure pulses typically represent binary-coded digital signals analogous to the variable being measured.

The drilling mud is pumped at high pressure from the surface downwardly through the interior of interconnected lengths of drill pipe (the "drill string") to cool and carry rock chips away from a drill bit at the bottom of the borehole. The cutting-laden mud then returns to the surface in an annular flow passage between the borehole wall and the exterior of the drill string. The mud pressure in the annulus is much lower than in the interior of the drill string above the drill bit due to the pressure drop across mud nozzles or jets in the bit.

Two styles of "mud pulse" telemetry are presently known to the industry. Positive-pulse systems use a downhole valve which restricts or briefly blocks mud flow to the bit to produce a surface-detectable pressure increase or positive pulse. Negative-pulse systems bypass the pressure drop across the bit by opening a flow passage to the annulus from the drill-string interior above the bit, thus producing a surface-detectable pressure decrease or negative pulse.

U.S. Pat. Nos. 2,925,251, 3,958,217, 3,964,556 and 3,983,948 disclose positive-pulse systems. Negative-pulse systems are disclosed or discussed in U.S. Pat. Nos. 3,983,948 and 4,078,620, and in British patent application No. 2,009,473A published on June 13, 1979. The broad concept of opening a bypass channel to the annulus to signal a downhole condition is shown in U.S. Pat. No. 2,887,298. The disclosures of these publications are incorporated herein by reference to the extent that they show operating features of the overall mud-pulse telemetry system in addition to specific styles of mud valves.

The valve of this invention is for use in negative-pulse systems. In contrast to prior-art negative-pulse valves which are bi-stable (and hence remain in either an open or closed position until electrically commanded to change state), the new valve is monostable in that it will "fail safe" to a closed position in the event of most power failure or other command-system breakdowns. The risk of the valve sticking open is minimized at the expense of a relatively small consumption of electrical power needed to maintain a pilot valve in a position which hydraulically holds open the main valve. This fail-safe property is helpful in avoiding loss of necessary mud flow to the drill bit, and to avoid possible drill-string washout over a period of time.

The valve has a horizontally oriented main closure member which is mounted for movement in a direction perpendicular to the drill-string axis to minimize the influence of vertical acceleration on the valve. The closure member is hydraulically urged against a floating seat, and both the closure member and seat are replaceable in the field without dismantling of the overall valve structure. Electrical power requirements are minimized by the pilot-valve system which enables most of the energy needed to actuate the closure member to be extracted from the flowing high-pressure mud stream.

Some known mud-pulse telemetry systems require temporary stopping of a rotary-drilling operation and the attendant flow of high-pressure mud to the drill bit. These systems depend on a static column of mud for transmission of a signal to the surface. The valve of this invention, however, is suitable for logging-while-drilling ("LWD") systems which are capable of sending surface-detectable pulses through a flowing (and hence turbulent and noisy) mud column, thus avoiding the recognized problems attendant to even short-term cessation of bit rotation and mud flow.

SUMMARY OF THE INVENTION

The valve assembly of this invention includes an outer housing which is preferably a drill collar fitted in the drill string above the rock bit. An inner housing which includes a valve body is fitted within and secured to the outer housing, and the inner housing is preferably centrally positioned by a mounting spider to form an annular passage for mud in the drill string flowing to the bit. A piston-like closure member extends laterally from the valve body across the annular mud passage to be movable against and away from a valve seat on the outer housing to close and open an orifice or passage through the outer housing for venting high-pressure mud within the drill string to the relatively lower pressure mud stream in the annulus between the borehole wall and the drill string.

The inner end of the closure member is fitted in the valve body to be in fluid communication with a mud-filled internal chamber in the body. Another chamber in the body surrounds an intermediate part of the closure member, and is in fluid communication with relatively low-pressure mud in the annulus via an internal passage in the closure member. An electrically controlled pilot valve in the inner housing enables the valve-body chambers to be selectably isolated or connected so the fluid pressure acting on the closure member can be varied to impose opening and closing forces on the member.

The valve seat on the outer housing is defined by a removable seat assembly which can be replaced in the event of damage or wear without requiring access to the inside of the outer or inner housings. When the seat assembly is removed, the closure member can also be withdrawn from the outside of the outer housing and without major disassembly of the entire valve system. Preferably, the seat assembly provides a floating mounting enabling slight lateral movement of the seat with respect to the closure member, and a resilient pad in the assembly cushions the seat against mechanical shock when the valve is closed.

Preferably, the outer end of the closure member tapers to an abrupt flat tip which is exposed to the annulus when the closure member is closed against the seat. The internal passage through the closure member terminates at the flat tip so the passage is exposed to the relatively lower annulus pressure when the closure member is seated. When the closure member is retracted from the seat, high-velocity mud flow past the tapered end of the closure member maintains a relatively low fluid pressure in the passage.

DESCRIPTION OF THE PREFERRED EMBODIMENT

Figure 1:
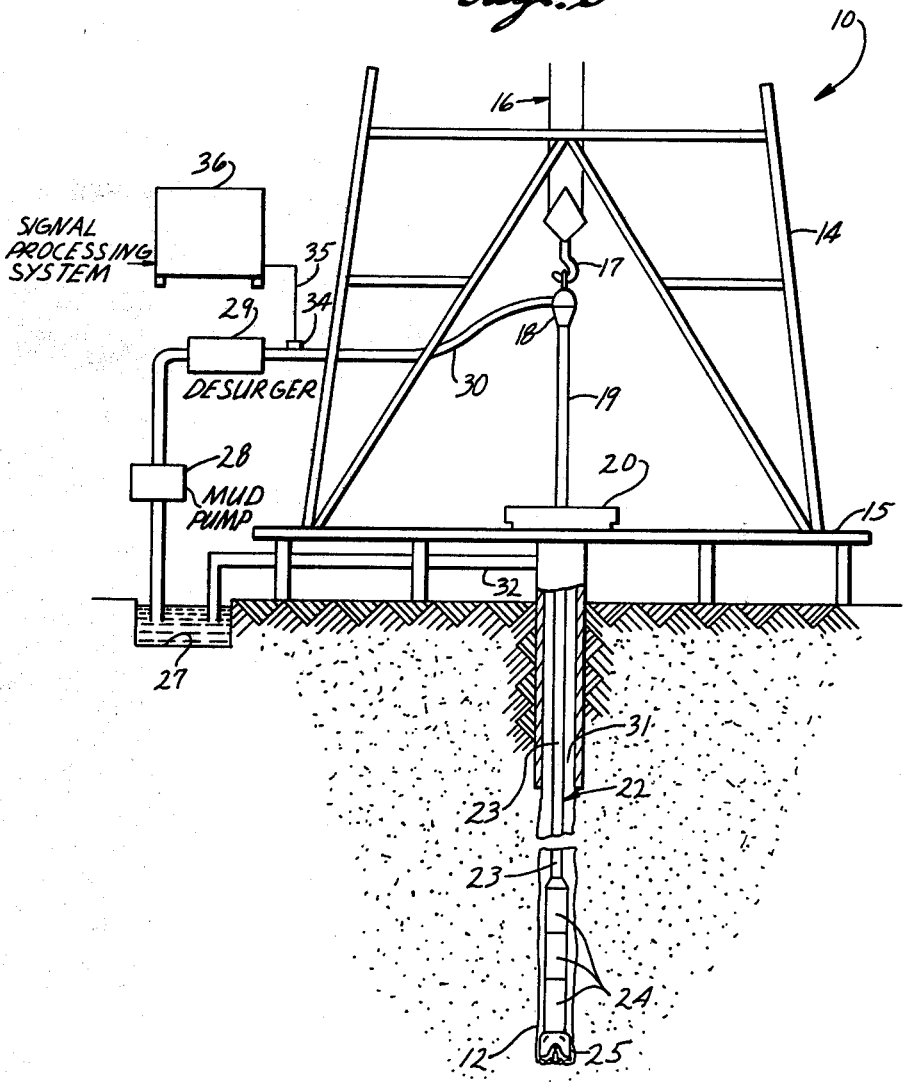
FIG. 1 is an elevation of a typical oil-well drilling rig in which the valve of this invention is useful.

FIG. 1 shows some of the elements of a typical oil-well rotary drilling rig 10 in which the valve of this invention is useful. The rig is shown as drilling a partially completed borehole 12, and includes such conventional components as a derrick 14, derrick floor 15, drawworks 16, hook 17, swivel 18, kelly joint 19, rotary table 20, and drill string 22. The drill string is made up of interconnected lengths of drill pipe 23, the upper end of the string being secured to the lower end of kelly joint 19. The lower end of the string is secured to interconnected drill collars 24, and a rotary drilling bit or rock bit 25 is secured beneath the lowermost drill collar.

Drilling fluid or "mud" circulates from a mud pit 27 through a mud pump 28, a desurger 29, and a mud supply line 30 to flow into swivel 18. The mud flows down through the hollow interiors of the kelly joint, drill string, and drill collars, and emerges through orifices or jets (not shown) in the rock bit to clean and cool the bit cutting surfaces, and to scour rock cuttings and fragments from the bottom of the borehole.

The mud returns to the surface from the bottom of the borehole through an annulus 31 between the drill string and borehole wall to flow back to mud pit 27 through a mud return line 32. The mud return line includes a conventional filter such as a shaker screen (not shown) for separating formation cuttings from the mud before it is returned to the mud pit.

A pressure transducer 34 in mud supply line 30 measures and detects variations in drilling mud pressure at the surface on the downstream side of the mud pump and desurger. The transducer has an output electrical signal analogous to drilling-mud pressure, and the signals are transmitted by a cable 35 to a conventional signal-processing system 36 arranged for recording and display of the signals. The transducer and signal processing system are not part of the present invention, and may be of the type described in greater detail in the aforementioned U.S. Pat. No. 4,078,620 or British patent application No. 2,009,473A.

Figure 2:
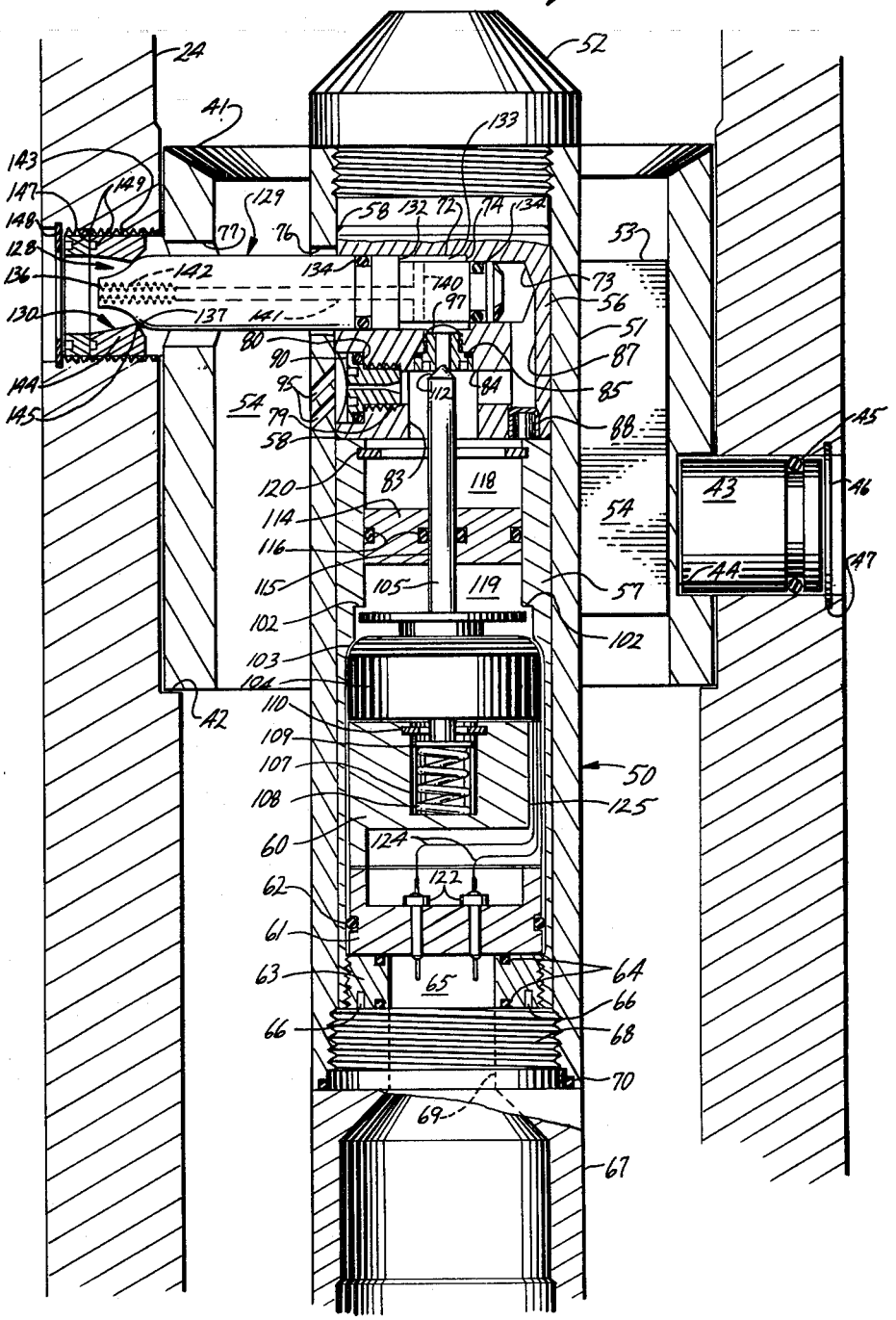
FIG. 2 is a sectional elevation of a valve according to the invention.

Referring to FIG. 2, a servo valve assembly 40 according to the invention is supported within any one of drill collars 24 to be upstream (with respect to the flow of drilling mud) of the rock bit and the bottom of the borehole. A support sleeve 41 for the valve assembly is seated against an upwardly facing annular shoulder 42 formed in the inner wall of the drill collar. The support sleeve is locked in place against the shoulder by a cylindrical anchor plug 43, the inner end of the plug being seated in a blind cylindrical recess 44 in the outer surface of the sleeve. A conventional O-ring seal 45 prevents leakage of mud past plug 43 from the interior of the drill string to the annulus, and the plug is secured in place by a snap retaining ring 46 seated in an annular groove 47 in the drill-collar sidewall.

A hollow valve housing 50 includes a cylindrical outer sleeve 51 which is closed at its upper end by an externally threaded cap or plug 52. Outer sleeve 51 is centrally positioned within support sleeve 41 by a spider mounting having a plurality of radially extending ribs 53 (only one of which is shown in FIG. 2) welded to the support sleeve and outer sleeve. An annular space 54 is thus formed between the valve housing and support sleeve to enable free circulation of drilling mud downwardly within the drill collar to the rock bit.

The valve housing includes a number of other components supported within outer sleeve 51. A valve body 56 is generally cylindrical to make a slip fit within the outer sleeve, and the upper end of the valve body abuts the underside of plug 52. Immediately beneath the valve body is an inner sleeve 57 which also makes a slip fit within the outer sleeve. O-ring seals 58 are fitted in annular grooves at the upper and lower ends of the valve body.

Positioned below and spaced apart from the valve body within the inner sleeve is a cylindrical solenoid support block 60. A lower plug 61 also makes a slip fit within the inner sleeve to abut the lower end of the solenoid support block. An O-ring seal 62 is fitted in an annular groove in the periphery of the lower plug to prevent fluid leakage between the plug and inner sleeve.

An externally threaded lock ring 63 is threaded into the lower end of the inner sleeve against the underside of the lower plug. O-ring face seals 64 are provided in the opposed end faces of the lock ring to prevent fluid leakage, and the ring has a central opening 65, and a pair of recesses 66 on opposite sides of the opening to receive a spanner wrench for installing or removing the ring.

The valve housing also includes an auxiliary housing 67 having an externally threaded upper end 68 which is received in the lower internally threaded end of outer sleeve 51. Upper end 68 of the auxiliary housing has a central opening 69 in alignment with opening 65 in the lock ring. An O-ring seal 70 seated in a groove at the lower end of the outer sleeve prevents fluid leakage between these components. As further described below, the function of the auxiliary housing is to provide space for mounting of electronic components and a power source such as a battery or mud-turbine generator (not shown).

Referring again to valve body 56, this component is a solid cylindrical piece of metal into which a number of openings are bored to form interconnected internal passages. A blind and cylindrical closure-member bore 72 is positioned adjacent the upper end of the valve body, and extends diametrically from a side surface of the body to terminate short of the opposed side surface.

The longitudinal axis of the closure-member bore intersects and is perpendicular to the longitudinal axis of the valve body.

Bore 72 is decreased in diameter adjacent its inner end 73 to define a shoulder 74. The valve body is positioned within the outer sleeve so that the closure-member bore is radially aligned with clearance openings 76 and 77 extending through the sidewalls of outer sleeve 51 and support sleeve 41 respectively, the clearance openings being of somewhat larger diameter than the closure-member bore.

An orifice-receiving bore 79 is formed in the valve body beneath and in radial alignment with the closure-member bore. The depth of bore 79 corresponds to that of bore 72, and bore 79 is inwardly stepped or reduced in diameter to form an outwardly facing shoulder 80.

A central axial bore 83 extends from the undersurface of the valve body upwardly into communication with the closure-member bore. Bore 83 also intersects and communicates with the central part of bore 79, and is twice reduced in diameter to form downwardly facing shoulders 84 and 85.

The internal passages within the valve body are completed by an off-axis bore 87, the central axis of which is radially spaced from and parallel to the central longitudinal axis of the valve body and bore 83. Bore 87 is diametrically opposite the outer ends of bores 72 and 79, and is positioned to be in communication with the inner ends of these two lateral bores. The outer end of the off-axis bore is closed by a Lee plug 88 or any similar plug which may be threaded or welded in place.

A flow-restricting orifice 90 having a small central passage or opening 91 therethrough is threaded into the outer end of bore 79, and the orifice has an enlarged head 92 which seats against shoulder 80. An O-ring seal 93 is provided in an annular groove in the undersurface of the head, and recesses 94 in the head enable installation and removal of the orifice with a spanner wrench. A pair of upwardly sloping passages 95 extend through the sidewall of outer sleeve 51 from annular space 54 into communication with orifice opening 91.

A pilot-valve seat 97 is threaded into the valve body to be positioned in the inner end of central axial bore 83. Seat 97 has an enlarged head 98 which is stopped against shoulder 85, and an O-ring seal 99 is provided between these surfaces. Recesses 100 in the bottom surface of head 98 enable the pilot-valve seat to be installed or removed with a spanner wrench.

The inner surface of inner sleeve 57 is twice enlarged in diameter to define a downwardly facing shoulder 102 and a curved shoulder 103 positioned below shoulder 102. A solenoid actuator 104, which may be of a conventional Ledex type, makes a slip fit within the lower end of the inner sleeve to seat against shoulder 103. The solenoid actuator is locked in position against the shoulder by solenoid support block 60, lower plug 61, and lock ring 63.

The actuator has a movable armature or core 105 which is a cylindrical shaft extending through the main body of the actuator. The lower end of core 105 extends downwardly into a centrally positioned blind bore 107 which extends downwardly from the upper surface of solenoid support block 60. A compression spring 108 is seated in bore 107, and a circular plate 109 is secured to the upper end of the spring to bear against the bottom of the actuator core. A retaining ring 110 is seated in an annular groove adjacent the upper end of bore 107 to hold the spring in the bore during assembly or disassembly of the system.

Solenoid-actuator core 105 has a conically tapered upper end 112 which seats against and closes the central opening through seat 97 when the solenoid is not energized. As further explained below, upper end 112 and seat 97 form a pilot valve which controls the flow of fluid within the valve body in response to actuating commands to the solenoid.

A piston 114 makes a close slip fit within the upper end of inner sleeve 57 above the solenoid actuator, and the piston has a central opening 115 through which actuator core 105 extends. O-ring seals 116 are seated in grooves in the inner and outer side surfaces of the piston to prevent fluid leakage between the piston, actuator core, and inner sleeve.

The piston divides the valve housing into two chambers. An upper chamber 118 is in fluid communication with the passages in valve body 56, and is accordingly filled with mud during drilling operations. A lower chamber 119 is filled with oil which flows into all of the spaces below the piston and above lower plug 61, including spring-chamber bore 107 (thus partially pressure balancing the solenoid-actuator core). The piston is a pressure-equalizing device which maintains the oil in the lower part of the valve housing at substantially the same pressure as the drilling mud in the upper part of the housing. A retaining ring 120 is fitted in an annular groove in the inner surface of the inner sleeve adjacent its upper end to retain the piston in its cylinder during assembly and disassembly of the system.

A pair of conventional electrical feed-through terminals 122 are fitted in a pair of openings extending vertically through lower plug 61. The terminals are secured to the plug in sealed relationship to prevent fluid leakage through the openings past the terminals. Electrical leads 124 from the solenoid actuator are connected to the inner ends of the terminals, and the terminal outer ends are accessible for connection to electrical apparatus in auxiliary housing 67. A clearance slot 125 is formed in the sidewall and along the length of solenoid support block 60 to accommodate leads 124.

A main mud-pulse valve 128 is defined by a generally cylindrical piston-like poppet or valve-closure member 129 and a seat assembly 130. The closure member extends through clearance openings 76 and 77 in the valve housing and support sleeve, and the member makes a close slip fit within closure-member bore 72 in the valve body. The inner end of the closure member within the valve body is reduced in diameter to define an inwardly facing shoulder 132. Shoulders 74 and 132 on the valve body and closure member respectively define an annular chamber 133 around the inner portion of the closure member and in communication with the central opening through pilot-valve seat 97. O-ring seals 134 are seated in annular grooves in the closure member on opposite sides of chamber 133 to prevent fluid leakage between the closure member and bore 72.

The outer end of closure member 129 terminates in a flat tip 136 of reduced diameter, and the surface connecting the tip with the main cylindrical body of the closure member is generally in the shape of a ogival or reverse-curve figure of revolution. A rear or inner portion of this ogival surface defines a seating surface 137 which closes against seat assembly 130 when the main mud-pulse valve is closed.

A small-diameter crossbore 140 extends diametrically across the valve-closure member just rearwardly of shoulder 132. A centrally positioned axial bore 141 extends from crossbore 140 to flat tip 136 of the closure member. Bores 140 and 141 thus place the outer tip of the closure member in fluid communication with annular chamber 133 within the valve body. Preferably, an outer end 142 of bore 141 is internally threaded to receive a threaded shaft (not shown) useful as a removal tool if it is necessary to remove and replace the closure member.

Seat assembly 130 is positioned in a threaded bore 143 which extends through the sidewall of drill collar 24 in alignment with clearance openings 76 and 77, and the central axis of the valve-closure member. The seat assembly includes a seat ring 144 which is externally threaded to be received in bore 143. A central opening through the seat ring flares outwardly at the inner end of the seat ring to define a seating surface 145 which mates with the corresponding surface on the valve-closure member. The remainder of the inner surface of the seat ring is outwardly flared as it extends to the outer end of the ring.

Seat ring 144 is preferably made of or faced with a hard, abrasion-resistant material such as tungsten carbide. Seating surface 145 is preferably contoured to provide a substantially line contact with the seated closure member to divide the nose of the member into two surface-area zones against which the higher and lower fluid pressures act to provide predictable and repeatable operating forces on the member.

An externally threaded lock ring 147 is inserted into threaded bore 143 to lock the seat ring in position in the drill collar. A retaining ring 148 is fitted in an annular groove in bore 143 to insure that the components of the seat assembly will be held in place. Recesses 149 are provided in both the seat ring and retaining ring to enable these parts to be installed or removed by a spanner wrench.

Figure 3:
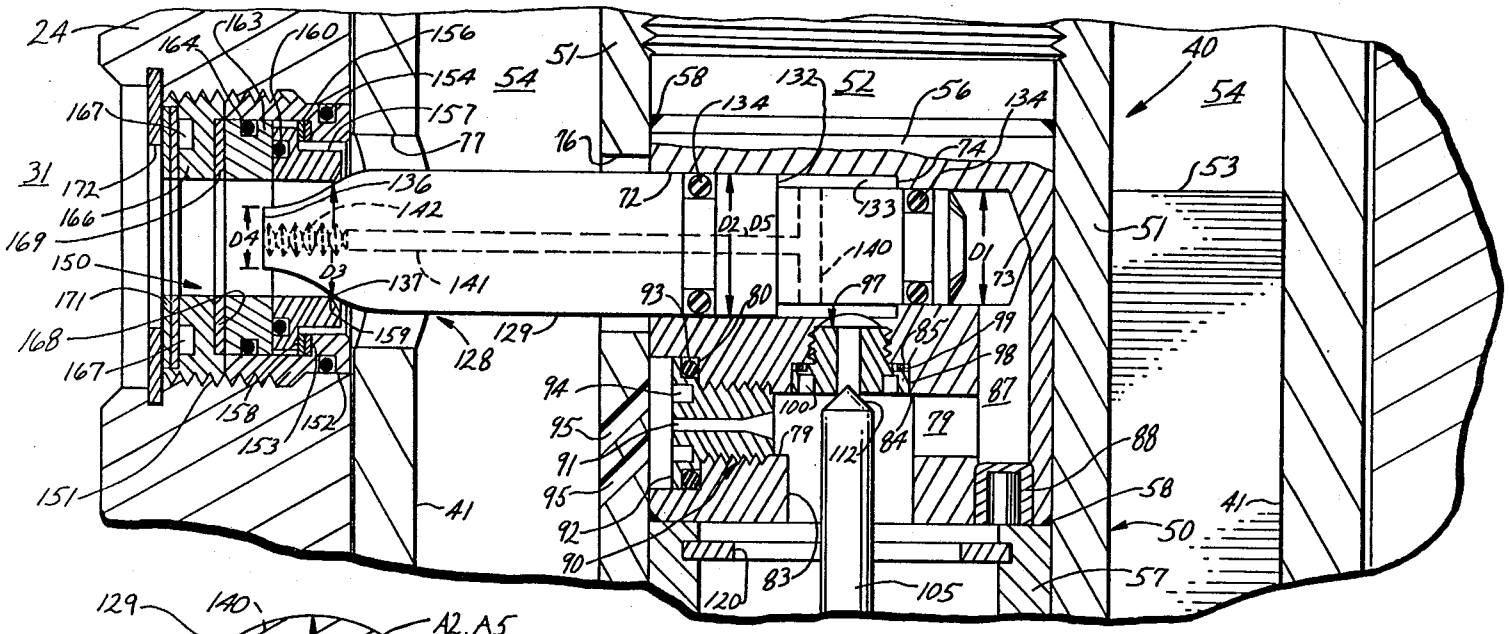
FIG. 3 is an enlarged view of an upper portion of FIG. 2 showing an alternative and presently preferred valve seat assembly.

FIG. 3 of the drawings is an enlarged view of an upper portion of the servo valve assembly shown in FIG. 2, and FIG. 3 also differs from FIG. 2 in that it shows a modified and presently preferred seat assembly 150 for the main mud-pulse valve. The modified seat assembly is secured in an internally threaded opening 151 which extends through drill collar 24, and the axis of this opening is aligned with the longitudinal axis of valve-closure member 129 as already described with respect to FIG. 2.

Seat assembly 150 includes an externally threaded retaining sleeve 152, the inner end of which is flush with the inner surface of the drill collar. The internal diameter of the retaining sleeve is stepped to define an outwardly facing shoulder 153, and an O-ring seal 154 is positioned in an annular recess adjacent the inner end of the sleeve to prevent leakage between the sleeve and drill collar.

A selectable number of spacing washers 156 are positioned within sleeve 152 against shoulder 153. A hollow seat ring 157 has an enlarged head with an inwardly facing shoulder 158, and the seat ring is loosely fitted within the retaining sleeve with shoulder 158 supported by spacing washers 156. The inner end of the seat ring defines a bevelled seating surface 159, and an O-ring seal 160 is positioned in an annular recess in the outer end surface of the seat ring.

A hollow cylindrical retaining piston 163 makes a close slip fit within the outer end of retaining sleeve 152, and the inner end of the retaining piston is positioned against the outer end surface of the seat ring. An O-ring seal 164 is positioned in an annular groove in the perimeter of the retaining piston.

An externally threaded lock ring 166 is threaded into the outer end of opening 151 in the drill collar to abut and lock in place the retaining sleeve. Recesses 167 are provided in the outer end surface of the lock ring to enable use of a spanner wrench for installation and removal of the ring. The inner end surface of the lock ring defines an annular recess 168 which receives a washer-shaped resilient pad 169 resting on the outer surface of retaining piston 163. Pad 169 is preferably made of silicone rubber of 70 to 90 shore hardness.

A selected number of outer spacing washers 171 are positioned over the outer end of lock ring 166. The outer spacing washers are secured in place by a snap retaining ring 172 seated in an annular groove in the drill collar opening. As shown in FIG. 3, the internal diameters of the seat ring, retaining piston, resilient pad, lock ring, and outer spacing washers are identical to provide a smooth passage for the flow of drilling mud when the valve is open.

Seat assembly 150 has several advantages over the somewhat simpler corresponding assembly shown in FIG. 2. First, the number of inner and outer spacing washers may be adjusted to shift the seat position, and thus to enable adjustment of the flow area through the valve when the valve is in an open position. This feature is useful, for example, when rock bits having drilling-fluid jets of varying sizes are used in the drilling operation.

A second advantage of seat assembly 150 is that resilient pad 169 cushions the closing shock of the valve when the closure member is moved against the seat ring, and the resilient pad also permits the seat ring to "float" slightly to compensate for any minor misalignment between the valve-closure member and seating surface 159.

Another advantage of the preferred seat assembly arises from the relatively loose fit of the seat ring within the retaining sleeve. The outside diameters of the seat ring are preferably about 0.020-inch less than the corresponding inside diameters of the sleeve, thus providing about 0.010-inch lateral freedom on either side of a perfectly centered position to accommodate any lateral misalignment between the seat and closure member.

During drilling operations, the servo valve assembly is maintained in a normally closed position (with valve-closure member 129 closed against seat assembly 130 or 150) by the differential pressure between drilling mud within the valve assembly, and mud flowing back to the surface in annulus 31 outside of the drill collar. This differential pressure is typically in the range of 1000 to 3000 psi, and it arises primarily from the pressure drop occurring when the mud is ejected through jets in the rock bit at the bottom of the hole. The absolute pressure of the drilling mud is of course substantially higher than this differential pressure as a result of both the pumping action of mud pump 28 and the hydrostatic head of the mud column, and bottom-hole mud pressures of say 15,000 psi are not uncommon in modern drilling operations. The operation of the servo-valve assembly, however, is controlled by the differential mud pressure which exists between the inside and the outside of the drill collar, rather than by the absolute pressure of the mud column.

Actuation of the mud-pulse valve is controlled by opening or closing the pilot valve which is defined by pilot-valve seat 97 and upper end 112 of solenoid core 105. When the solenoid is not electrically energized, the pilot valve is closed by the restoring force exerted by compression spring 108 on the lower end of solenoid core 105. With the pilot valve closed, the internal chamber of the valve housing is filled with relatively high-pressure mud at pressure P1, this pressure corresponding to the pressure of the mud within the drill string and drill collar above the rock bit. The mud pressure within the valve housing is equalized with the mud pressure outside of the valve housing by orifice 90 which connects the valve-housing chamber to annular space 54.

The mud pressure P1 is thus exerted against the rear end surface of the valve-closure member behind rear O-ring 134. A relatively lower force tending to urge the valve-closure member into an open position is exerted (by the lower pressure mud at pressure P2 in annulus 31) on the outer end of the valve-closure member which projects beyond the seat of the mud-pulse valve. This force, however, is insufficient to overcome the substantially larger closing force exerted on the inner end of the closure member, and the net reaction is a force urging the closure member against its seat to hold the mud valve in a closed position.

Two other forces are also applied to the closure member in the closed position. First, the relatively high-pressure mud at pressure P1 in space 54 acts on the relatively small annular surface of the nose of the closure member rearwardly of the seat, resulting in a relatively small opening force which is insufficient to overcome the larger closing force applied at the rear of the closure member. Second, the pressure P2 of the mud returning to the surface through annulus 31 is transmitted through axial bore 141, cross bore 140, and annular chamber 133 to react against shoulder 132, and this force tends to augment the main closing force applied at the rear of the closure member. The net reaction of these forces is to urge the valve open, but this net force is insufficient to overcome the main net closure force arising from mud at pressure P1 acting on the rear or inner end of the closure member.

When the mud-pulse valve is to be opened to generate the leading edge of a mud-pulse signal, solenoid actuator 104 is electrically energized to retract the actuator core and withdraw tapered upper end 112 of the core from the pilot valve seat. As the pilot valve opens, the pressure within the valve-housing chamber quickly drops to pressure P2 corresponding to the pressure of the low-pressure mud in annulus 31. This is so because the open pilot valve places the valve-housing chamber in fluid communication (through bores 140 and 141 in the closure member) with annulus 31. Flow-restricting orifice 90 remains open to mud at pressure P1 in space 54, but the orifice is significantly smaller than the passages through the pilot valve and closure member, and mud flow through orifice 90 is insufficient to maintain a high pressure within the valve-housing chamber.

As a result of the sudden reduction in pressure against the rear end of the closure member, the opening forces exerted on the outer end of the closure member overpower the closing forces, and the valve member moves (to the right as seen in FIG. 2) away from its seat to open the valve. Mud behind the retracting closure member is pumped through the open pilot valve and passages 140 and 141 into annulus 31. As the valve opens, high-pressure mud in space 54 then jets out of the mud-pulse valve into annulus 31, resulting in a sharp reduction in mud pressure P1 which is detectable at the surface by transducer 34.

A significant feature of the disclosed shape of the outer end of the closure member is to provide a relatively low pressure at flat tip 136 during all operating modes of the mud valve. The tapering (and preferably reverse-curve or ogival) shape of the outer end, coupled with the abrupt transition at the flat tip, assures smooth flow lines which separate cleanly from the closure member in the open position. This flow separation and jetting action create a low pressure at the flat tip (and hence in crossbore 140 and axial bore 141), and this pressure may be significantly lower than pressure P2 in the annulus.

The design of the closure member tip insures that a relatively low (with respect to pressure P1) fluid pressure is available for transmission to the valve interior without regard to closure-member position. This access to a low-pressure region, coupled with the flow-throttling action of opening 91 in flow-restricting orifice 90, enables maintenance of a net opening force on the closure member when the pilot valve is open. This net opening force is maintained by fluid pressure without use of spring forces on the closure member or separate auxiliary passages connecting the valve housing to the annulus.

To close the valve, the solenoid actuator is de-energized, and the pilot valve is closed in response to the action of compression spring 108. The pressure within the valve-housing chamber is then increased to pressure P1 as a result of mud flow through flow-restricting orifice 90. As the mud pressure acting against the rear end of the closure member approaches pressure P1, the closing forces overcome the opening forces, and the closure member moves (to the left as seen in FIG. 2) until the closure member is fully seated. Closure of the main valve thus forms the trailing edge of a surface-detectable negative mud-pressure pulse.

Figure 4:
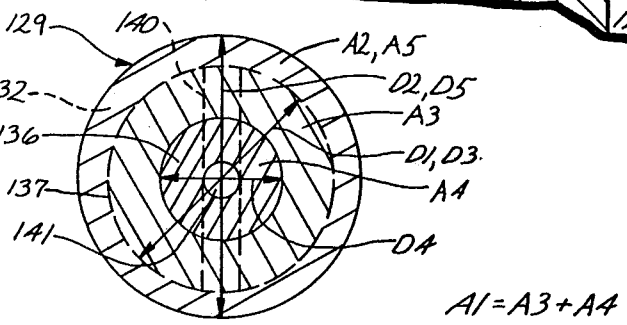
FIG. 4 is an enlarged axial end view of the outer end of a closure member in the valve, and cross hatching is used to designate different frontal areas rather than sectioning of the part.

To insure proper pressure balancing of the closure member in its various operating positions, the surfaces on which the mud pressures act must be properly sized with respect to surface area. The important dimensions of a presently preferred configuration as shown in FIGS. 3 and 4 are as follows, it being noted that the hatching in FIG. 4 designates frontal surface areas, rather than sectioning of the closure member:

a. D1 is the diameter of closure-member bore 72 behind shoulder 74, and corresponds to the diameter of an area A1 which the effective area (closure member and rear O-ring seal 134) against which the mud pressure acts at the rear of the closure member.

b. D2 is the diameter of the enlarged portion of closure-member bore 72 forwardly of shoulder 74, and corresponds to the overall diameter of the main body of the closure member including forward O-ring seal 134. D1 is subtracted from D2 to calculate the effective annular surface area A2 on which mud in annular chamber 133 acts.

c. D3 is the diameter of the "nose" of the closure member at seating surface 137, and is the diameter of the total surface area (A3+A4) which faces annulus 31 when the valve is closed. Preferably, D3 is equal to D1.

d. D4 is the diameter of flat tip 136 of the closure member, and is the basis for calculating total surface area A4 of the tip (including the area at the rear end of axial bore 141). D4 is subtracted from D3 to calculate annular effective surface area A3 on the nose of the closure member behind flat tip 136.

e. D5 is the major diameter of the main body of the closure member, and is substantially equal to D2. D3 is subtracted from D5 to calculate the effective annular surface area A5 at the tapered end of the seated closure member inwardly of seating surface 137 and against which pressure P1 in annular space 54 acts when the mud-pulse valve is closed.

In a typical configuration which has been successfully tested, bores 140 and 141 in the closure member are about 0.125 inch in diameter, and the same or a slightly larger diameter is used for the passage through pilot-valve seat 97. The central passage through flow-restricting orifice 90 has a diameter of about 0.052 inch. The other diameter and areas discussed above are as follows:

| Diameters | Areas |
|---|---|
| D1 = D3 = 0.613 inch | A1 = A3 + A4 = 0.295 inch |
| D2 = D5 = 0.738 inch | A2 = A5 = 0.133 inch |
| D4 = 0.250 inch | A3 = 0.246 inch |
| | A4 = 0.049 inch |

Assuming a nominal pressure drop across the rock bit of 2000 psi, the force holding the closure member against its seat is 2000 psi (A1−A2)=2000 psi (0.162 inch)=324 pounds. The maximum force initially driving the valve open when the solenoid actuator is energized to open the pilot valve is approximately 2000 psi (A2)=2000 psi (0.133 inch)=266 pounds, assuming that the internal pressure in the valve body drops to about P2 when the pilot valve opens.

The force holding the fully retracted closure member in the fully open position is somewhat less than the initial opening force, and depends primarily on the fluid pressure exerted on areas A3 and A5 in the intense and complex flow field through the open mud-pulse valve. The separation of the jet flow lines at the tip of the retracted closure member places area A4 in a zone of low pressure which may be significantly less than annulus pressure P2.

The valve has a crisp opening motion which generates a negative mud-pressure pulse with a sharp leading edge for easier detection at the surface. Closure-member velocity can be damped by inserting a flow restrictor (of, for example, about 0.0625 inch passage diameter) in the outer end of passage 141 to restrict the flow of mud pumped out of the valve-housing chamber as the closure member retracts. Closing-shock damage of the closure member and seat is prevented by the damping action of orifice 90 which restricts the rate of pressure increase within the valve chamber when the pilot valve is closed.

Another approach is minimizing opening shock is to configure the rear or inner end of the closure member and inner end 73 of bore 72 such that the flow of mud into bore 87 is throttled as the closure member approaches a fully retracted position. That is, the size of the passage through which mud is pumped into bore 72 can be decreased as full retraction is approached by appropriately shaping the rear ends of the closure member and the cylindrical bore in which the closure member moves.

The solenoid actuator is energized by a conventional power source such as a high-temperature battery, or a mud-driven turbine generator. Conventional transducers (e.g. pressure, temperature, inclination, etc.) measure the parameters of interest, and these signals are typically digitized in a downhole electronic system which generates binary on-off commands to the actuator. Housing space for these components is provided within auxiliary housing 67 which is dimensional to accommodate this equipment.

In a typical configuration, a solenoid actuator of the Ledex type has an operating voltage of 24 volts, and will draw about six amperes initial current as the pilot valve opens. Hold-open current needed to maintain the pilot valve in an open position is substantially lower, and typically in the range of one-half ampere.

To minimize the effects of flow erosion, the valve assembly has been disclosed in a form which maintains the pilot valve in a closed position except during mud-pulsing periods when the main mud-pulse valve is open (or transitioning from the closed to the open position). The invention, however, is not limited to this preferred configuration, and the inventive concepts can be embodied in a system in which the pilot valve is normally open, and is momentarily closed to unseat the closure member and momentarily open the mud-pulse valve. Such an "out of phase" operation can be achieved with a relatively simple modification of the disclosed assembly.

Briefly, one form of such a modified valve can be constructed as follows:

a. Enlarge the opening through flow-restricting orifice 90 to reduce the flow impedance through the orifice and to eliminate the throttling action of small opening 91.
b. Eliminate bore 87 so the rear or inner end of closure-member bore 72 is blind or closed.
c. Rearrange compression spring 108 to be positioned between the lower face of solenoid actuator 104 (or retaining ring 110) and a plate secured to the lower end of core 105, thus biasing the core downwardly to hold the pilot valve open unless the solenoid is actuated.
d. Rearwardly extend axial bore 141 to the rear end of the closure member to communicate with the now-closed space at the inner end of closure-member bore 72.
e. Insert a flow-restricting orifice in axial bore 141 to throttle flow through this passage.

When the pilot valve is in the normally open position, the rear end of the closure-member bore is "pumped up" to pressure P1 through crossbore 140 and rearwardly extended bore 141 and due to the throttling action of the repositioned flow-restricting orifice, thus holding the mud-pulse valve closed. Closure of the pilot valve enables the fluid pressure in the rear end of the closure-member bore to bleed down to about annulus pressure P2, resulting in a net opening force on the member. This is a workable configuration, but the arrangement shown in the drawings is preferred to provide low-duty-cycle flow conditions.

An important feature of the invention is that the mud-pulse valve is monostable or fail-safe in that it will automatically close in the event of a control-system power failure. The valve also has a relatively low frontal area and slim profile to minimize impedance to mud flow to the rock bit.

Another advantageous feature of the invention is that the closure member and seat (the components most subject to wear or damage during drilling operations) can be easily and quickly replaced in the field without removing the entire valve assembly from the drill collar. The seat and its associated locking components are readily accessible from the outside of the drill collar. When the seat assembly has been removed, the horizontally oriented closure member is easily slipped out of its housing through the opening in the drill collar.

In addition to ease of field replacement, the horizontal orientation of the closure member has several other advantages. The drill string is subject to severe vertical acceleration due to the shock and vibration encountered in rotary drilling. The horizontally oriented closure member is substantially isolated from these accelerations by its mounting in the valve body, and the risk of inadvertent actuation (as well as wear, and the need for heavy closure forces) is avoided. The solenoid-actuator core is subject to these vertical forces, but it is a low-mass element which is readily controlled by a relatively light closure spring.

In the presently preferred form herein disclosed, the closure member has an axis of linear movement which is perpendicular to the longitudinal axis of the drill string to advantages just discussed. It is not essential, however, that these axes be exactly at right angles, and other angulations can be used as long as the axes are laterally or transversely oriented.

It should be noted that most of the elements of the servo valve assembly are sheltered by the valve housing from the high-velocity flow of abrasive drilling mud. The outer end of the closure member and the seat are of necessity exposed to this abrasive flow, but these components can be made from abrasion-resistant materials. Mud flow within the valve body is at a relatively low velocity due to the restricting orifices, and the internal components are protected from wear which would occur if they were exposed to the main stream of drilling mud to the rock bit.

What is claimed is:

1. A valve assembly for a drilling-fluid telemetry system for sending information to the surface from a borehole drilled in the earth, the assembly being adapted for mounting in an elongated and generally vertical drill string extending from a surface end into the borehole to a lower end having a flow restriction, the drill string being hollow so drilling fluid pumped therethrough from the surface flows past the restriction and then returns to the surface through an annulus between the drill string and the borehole wall, comprising:

an outer housing adapted for inserting in the drill string between the surface and the restriction so drilling fluid can be pumped therethrough, the outer housing having an orifice extending laterally therethrough and defining a valve seat;

an inner housing supported within the outer housing, the housings having a space therebetween through which drilling-fluid circulation to the restriction can be maintained;

an elongated valve closure member mounted on and extendible from the inner housing into the space between the housings toward the valve seat to be movable between open and closed positions, the closure member having an outer portion urged against the valve seat to block the orifice in the closed position, and the outer portion being spaced from the seat in the open position to enable flow of drilling fluid through the orifice to the annulus, the closure member having an axis of linear movement which is lateral to the longitudinal axis of the drill string;

actuating means in the inner housing for moving the closure member from the closed position to the open position, and then back to the closed position to generate a negative pressure pulse in the drilling fluid which can be detected at the surface.

2. The assembly defined in claim 1 wherein the outer-housing orifice is defined by a seat member secured to the outer housing and arranged to be installed on and removed from the outer housing without requiring access to the inner housing, and wherein the closure member can be withdrawn from the inner housing through the outer housing when the seat member is removed.

3. The assembly defined in claim 1 wherein the outer-housing orifice is defined by a seat assembly secured to the outer housing; the seat assembly comprising a mounting means adapted for attachment to the outer housing in an opening extending through the outer housing, and a seat member having an orifice therethrough and a seating surface configured to receive the closure member in the closed position, the mounting means being arranged to permit limited movement of the seat member laterally of the direction of fluid flow through the orifice to align the seat and closure member.

4. The assembly defined in claim 3 wherein the seat assembly further comprises a resilient member disposed between the mounting means and seat member to cushion impact of the closure member against the seat member when the closure member is driven to the closed position.

5. The assembly defined in claim 1 wherein the actuating means is arranged for fluid actuation of the closure member by pressures of the drilling fluid in the drill string and annulus respectively, the actuating means including a pilot valve for varying the forces applied to the closure member to move the closure member between the open and closed positions.

6. The assembly defined in claim 5 wherein the inner housing includes means defining an interior chamber in communication with fluid pressure in the space between the housings, wherein the closure member defines a passage extending from an outer end of the closure member into the interior of the valve chamber, the outer end of the closure member being in communication with fluid pressure in the annulus in the closed position, and wherein the pilot valve is operative to enable and disable fluid flow between the interior chamber and the closure member passage.

7. The assembly defined in claim 6 wherein the outer end of the closure member terminates in a tip configured to create a zone of reduced pressure at the closure-member passage when the closure member is in the open position.

8. The assembly defined in claim 7 wherein the outer end of the closure member is shaped as a truncated ogival figure of revolution terminating in a substantially flat tip.

9. The assembly defined in claim 1 wherein the outer-housing orifice is defined by a seat assembly secured to the outer housing; the seat assembly comprising a mounting means adapted for attachment to the outer housing in an opening extending through the outer housing, and a seat member having an orifice therethrough and a seating surface configured to receive the closure member in the closed position, the mounting means including spacer means for enabling adjustment of seat-member position with respect to the mounting means in the direction of fluid flow through the orifice.

10. The assembly defined in claim 1, wherein the outer housing is a drill collar, and the inner housing is centrally supported within the drill collar to define a generally annular passage for the flow of drilling fluid between the drill collar and inner housing, the axis of linear movement of the closure member being perpendicular to the longitudinal axis of the drill string.

11. A valve assembly for a drilling-fluid telemetry system for sending information to the surface from a borehole drilled in the earth, the assembly being adapted for mounting in an elongated and generally vertical drill string extending from a surface end into the borehole to a lower end having a flow restriction, the drill string being hollow so drilling fluid pumped therethrough from the surface flows past the restriction and then returns to the surface through an annulus between the drill string and the borehole wall, the fluid in the annulus being at a lower pressure than the fluid in the drill string as a result of a pressure drop across the flow restriction, comprising:

an outer housing adapted for insertion in the drill string between the surface and the restriction so drilling fluid can be pumped therethrough, the outer housing having an orifice extending laterally therethrough and defining a valve seat;

a valve body supported within the outer housing to define a first space between the valve body and outer housing through which drilling-fluid circulation to the restriction can be maintained, the valve body having a first internal chamber, first and second interconnected passages configured to receive a closure member, the second passage being in fluid communication with the first chamber, a third passage extending between the first chamber and the first passage, and a fourth restricted passage smaller in size than the third passage and extending between the first chamber and said first space to admit a limited flow of drilling fluid from the first space into the first chamber;

a valve closure member mounted in the valve body to be movable between a closed position in which the member is positioned against the valve seat to block flow through the housing orifice, and an open position in which the closure member is spaced from the valve seat, the closure member having an inner end making a sealed slip fit in the second passage of the valve body, and having an intermediate portion making a sealed slip fit in the first passage of the body, the intermediate portion and first passage defining a second chamber therebetween in communication with the third passage, the valve assembly having a fifth passage extending from the second chamber into communication with the annulus; and a pilot valve on the valve body and arranged to open and close the third passage so the first chamber is filled with relatively high pressure drilling fluid from the first space when the valve is closed, and so the drilling-fluid pressure in the first chamber is reduced when the pilot valve is opened to communicate the first chamber with the annulus, whereby the valve closure member is moved between the open and closed positions by hydraulic action of the drilling fluid.

12. The assembly defined in claim 11, wherein the fifth passage is formed in the closure member to extend from the intermediate portion to an outer end of the closure member in communication with the annulus when the closure member is in the closed position.

13. The assembly defined in claim 12 wherein the closure member is a generally cylindrical piston which is reduced in diameter in the intermediate portion to define an annular shoulder facing the inner end and in contact with drilling fluid in the second chamber, the piston having a tapered outer end configured to make sealing contact with the valve seat.

14. The assembly defined in claim 13, wherein the piston inner end has a first effective area, the annular shoulder has a second effective area, the piston tapered outer end has a third effective area facing and in communication with the annulus when the piston is in the closed position, and the piston outer end has a fourth effective annular area in communication with the first space when the piston is in the closed position, the first effective area being larger than the second effective area.

15. The assembly defined in claim 14 wherein the first effective area is substantially equal to the third effective area, and the second effective area is substantially equal to the fourth effective area.

16. The assembly defined in claim 13 wherein the piston is generally horizontally oriented to have an axis of linear movement between the open and closed positions, the axis being lateral to the longitudinal axis of the drill string.

17. The assembly defined in claim 16 wherein the valve body is generally centrally positioned within the outer housing so the first space is a generally annular space, and the piston extends from the valve body across the first space to the valve seat when the piston is in the closed position.

18. The assembly defined in claim 17 wherein the pilot valve includes an electrically operated actuator which is mechanically biased to close the third passage when electrical power to the actuator is terminated.

19. The assembly defined in claim 13 wherein the outer end of the closure member terminates in a tip configured to create a zone of reduced pressure at the outer end of the fifth passage when the closure member is in the open position.

20. The assembly defined in claim 11 wherein the pilot valve includes an electrically operated solenoid actuator having a movable core which opens and closes the pilot valve, and a spring acting on the core to urge the pilot valve into a closed position when the solenoid actuator is not energized.

* * * * *